United States Patent [19]

Chen et al.

[11] Patent Number: 5,042,677

[45] Date of Patent: Aug. 27, 1991

[54] SAFETY RADIATOR CAP

[75] Inventors: Yen-Cheng Chen; Shu-Fahr Chang, both of Hsinchu, Taiwan

[73] Assignee: Industrial Technology Research Institute, Taiwan, Taiwan

[21] Appl. No.: 581,045

[22] Filed: Sep. 12, 1990

[51] Int. Cl.[5] ..... B65D 55/00

[52] U.S. Cl. ..... 220/201; 220/203; 220/316; 220/DIG. 32

[58] Field of Search ..... 220/201, 203, 231, 316, 220/DIG. 32

[56] References Cited

U.S. PATENT DOCUMENTS

| | | | |
|---|---|---|---|
| 2,125,419 | 8/1938 | Birk | 220/201 X |
| 2,250,045 | 7/1941 | Focke et al. | 220/201 |
| 2,528,372 | 10/1950 | Kellogg | 220/201 |
| 3,338,455 | 8/1967 | Miller | 220/DIG. 32 X |
| 3,373,894 | 3/1968 | Johnson | 220/301 |
| 3,559,839 | 2/1971 | Seethaler | 220/201 |
| 4,457,327 | 7/1984 | Pepper | 137/67 |
| 4,489,883 | 12/1984 | Anderson | 236/92 C |
| 4,732,188 | 3/1988 | Gabrlik | 137/73 |
| 4,872,584 | 10/1989 | Sakai | 220/201 |
| 4,927,049 | 5/1990 | Giordano | 220/201 |

*Primary Examiner*—Stephen Marcus
*Assistant Examiner*—Stephen Cronin
*Attorney, Agent, or Firm*—Scully, Scott, Murphy & Presser

[57] ABSTRACT

A safety radiator cap for radiator providing a safety plate or wire made of shape memory alloy. The safety plate or wire bends downward under ambient temperature. High temperature water in the radiator causes the safety plate to extend out due to the memory characteristic of the alloy, and the safety plate thus presses against the neck of the filling hole.

6 Claims, 4 Drawing Sheets

SAFETY RADIATOR CAP

BACKGROUND OF THE INVENTION

This invention relates to a safety radiator cap, in particular, for use in automobiles. The safety radiator cap provides a safety plate or wire made of a shape memory alloy. The shape memory effect of the shape memory alloy was known about 1950. It was found that the reversibility of the martensite transformation is the principal reason for the characteristic of shape recovery. The shape memory alloy appears as full martensite phase at temperatures below a critical temperature called martensite finishing temperature ($M_f$ in abbreviation) and becomes as full austenite phase after being heated above another critical temperature called austenite finishing temperature ($A_f$ in abbreviation). The stiffness of a shape memory alloy at austenite phase is much stronger than that at martensite phase. For example, the yield strength of a Ni-Ti shape memory alloy at austenite phase in general is four times of that at martensite phase. When, after running the engine, the water in the radiator becomes hot, the safety plate extends out due to its shape memory characteristic as soon as the temperature beyond $A_f$. When someone wants to open the radiator cap to add water into a hot radiator, the safety plate will press against the neck of the filling hole and quickly exhaust the steam. This thus prevents scalding with hot steam which might otherwise spray out from the filling hole of the radiator.

Although automobiles are the common vehicles for road transportation, we still often hear about drivers being scalded with hot steam due to their carelessness. We know that radiator water gradually dissipates while driving, and it is periodically necessary to add water. Although some radiators provide an overflow pipe for hot steam to escape, it cannot exhaust the hot steam completely in a short time and the steam left in the radiator is still very hot. When someone hurriedly opens the radiator cap, the steam sprays out and scalds him or her. The present invention overcomes this disadvantage of conventional radiator caps.

SUMMARY OF THE INVENTION

The present invention relates to a safety radiator cap which is an application of shape memory alloy. It utilizes the high temperature which is generated from the radiator to cause the shape memory alloy to act as a safety valve.

It is an object of the present invention to provide a safety radiator cap, wherein the structure is simple in construction and is easily operated.

Another object of the present invention is to provide a safety radiator cap comprising a safety plate or wire made of a shape memory alloy, wherein the safety plate acts by the changing water temperature of the radiator and it does not need any other energy.

A further object of the present invention is to provide a safety radiator cap that can be operated repeatedly and safely.

Still another object of the present invention is to provide a safety radiator cap that can exhaust vapor and act as a safety valve.

These and other objects, advantages and features of the present invention will be more fully understood and appreciated by reference to the written specification and appended drawings.

DETAILED DESCRIPTION OF THE PREFERRED EMBODIMENT

Figure 1:
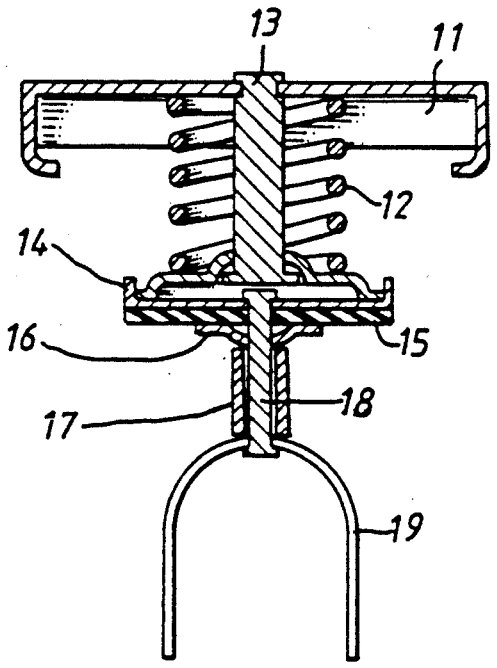
FIG. 1 is a cross-sectional view of a safety radiator cap illustrating the shape of the safety plate under ambient temperatures.
Figure 2:
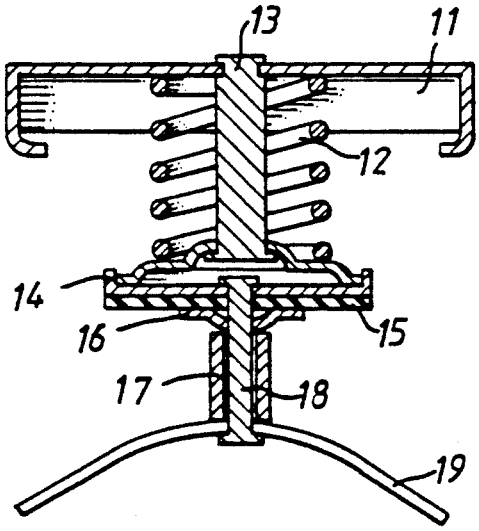
FIG. 2 is a cross-sectional view of a safety radiator cap illustrating the shape of the safety plate under high temperatures.
Figure 3:
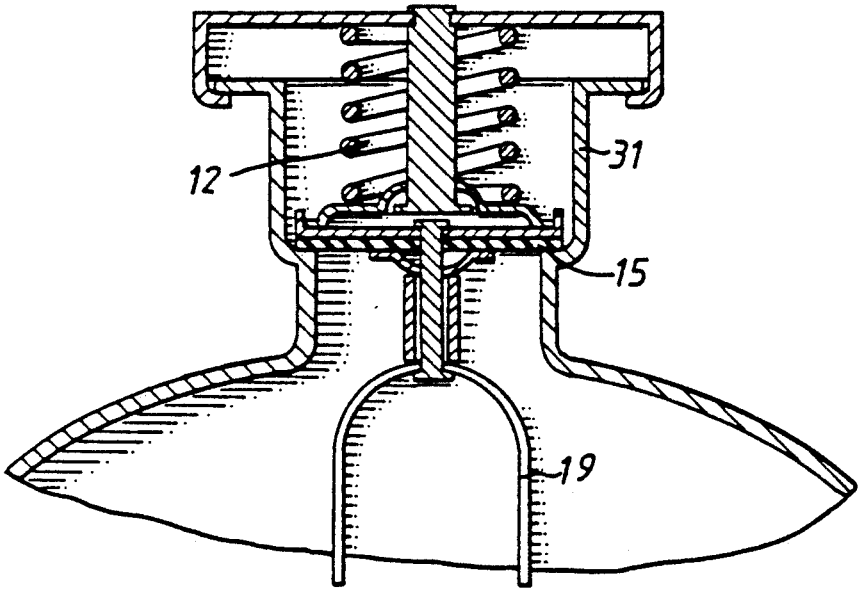
FIG. 3 is a cross-sectional view of a safety radiator cap in combination with part of the radiator illustrating the cap in a closed position and under ambient temperatures.

As shown in FIG. 1, a safety radiator cap of the present invention has a cap (11) and a steam outlet cover (14) connected by a first connecting element (13), preferably a rivet. The cap (11) is fixed at one end of the first connecting element (13). The steam outlet cover (14) is. movable axially on the other end of the first connecting element (13). A compression spring (12) is set between the cap (11) and the steam outlet cover (14) and encloses the first connecting element (13). A rubber gasket (15) is adhered to the bottom of the steam outlet cover (14) for covering the neck portion of filling hole (31) compactly (as shown in FIG. 3). A second connecting element (18), preferably a rivet, is fixed at the bottom of the steam outlet cover (14) and passes through the rubber gasket (15). The other end of the second connecting element (18) provides a safety plate (19) made of Ni-Ti shape memory alloy with $A_f$ temperature of about 90° C. A collar (17) is set on the safety plate (19). A gasket (16) is set between the rubber gasket (15) and the collar (17). The mechanical properties of the Ni-Ti shape memory alloy such as strength, fatigue allowance and super-elasticity are superior to other shape memory alloys like Cu-Zn-Al alloys. The Ni-Ti shape memory alloy has more than 6% of shape recovery during the change of temperature. The safety plate (19) is U-shaped under ambient temperatures. When the temperature rises beyond the $A_f$ temperature of the Ni-Ti shape memory alloy, the safety plate (19) extends out due to the memory characteristic (as shown in FIG. 2).

Figure 4:
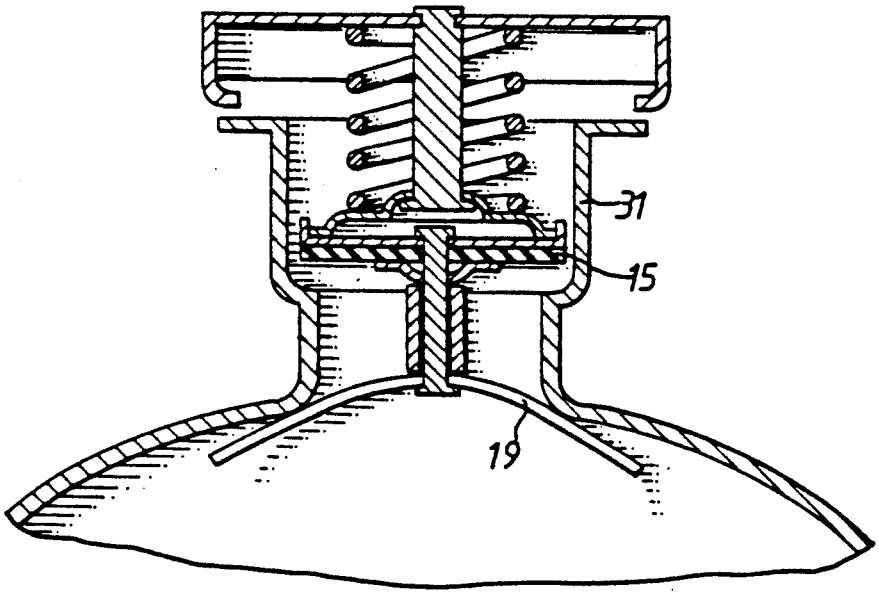
FIG. 4 is a cross-sectional view of a safety radiator cap in combination with part of the radiator illustrating the cap in an opened position and under high temperatures, wherein the safety plate presses against the neck of the filling hole.

Referring now to FIG. 3, the safety radiator cap in accordance with the present invention is in a closed position. The rubber gasket (15) covers the neck portion of filling hole (31) by the spring force of the compression spring (12). In FIG. 4, when the safety radiator cap is opened under high radiator temperatures, the safety plate (19) will press against the neck of the radiator and steam can exhaust through the clearance between the rubber gasket (15) and the filling hole (31) to vent in a short time. The safety radiator cap can be pulled out forcedly, because of the super-elasticity of the Ni-Ti alloy when it is at austenite phase, to add water to the radiator after the steam has been exhausted. The safety plate (19) may recover its original U-shape if it possesses two-way shape memory as the temperature reduces. Otherwise, one can press the spread Ni-Ti plate to U-shape easily by hand. Thus, the safety radiator cap can be safely closed. It takes little time to add water to the radiator and assures operator safety.

While the invention has been described with a certain degree of particularity, it is manifest that many changes may be made in the details of construction and the arrangement of components without departing from the spirit and scope of this disclosure. It is understood that the invention is not limited to the exemplified embodiment set forth herein but is to be limited only by the scope of the attached claims, including the full range of equivalency to which each element thereof is entitled.

We claim:

1. A safety radiator cap for a radiator comprising a cap and a steam outlet cover connected by a first connecting element, and a compression spring set between said cap and said steam outlet cover and enclosing said first connecting element, characterized in that:

a second connecting element fixed at one end thereof to the bottom of said steam outlet cover; and a safety plate or wire of shape memory alloy material provided at the other end of said second connecting element;

whereby both ends of said safety plate or wire bend downward under ambient temperature such that a clearance formed between both ends is smaller than the diameter of the neck of a filling hole of the radiator; and said ends of said safety plate or wire extend out to a horizontal position under high temperature and the extension length is larger than the diameter of the neck of said filling hole.

2. The safety radiator cap for a radiator according to claim 1, wherein said safety plate or wire and said steam outlet cover maintain a fixed length which is larger than the height of the neck of said filling hole to form a clearance between said steam outlet cover and the neck after the cover is moved upward and stopped by the extended safety plate or wire under high temperature.

3. The safety radiator cap for a radiator according to claim 1, wherein said safety plate or wire is Ni-Ti shape memory alloy.

4. The safety radiator cap for a radiator according to claim 3, wherein said safety plate or wire possesses one-way or two-way shape memory.

5. The safety radiator cap for a radiator according to claim 3, wherein said safety plate or wire appears as full austenite phase at temperatures beyond 90° C.

6. The safety radiator cap for a radiator according to claim 1, wherein said safety plate or wire is plate-shaped or bar-shaped.

* * * * *